US007658294B2

(12) United States Patent
Housley et al.

(10) Patent No.: US 7,658,294 B2
(45) Date of Patent: Feb. 9, 2010

(54) NURSING BOTTLE WITH CUSHIONY EXTERIOR SIDEWALL

(75) Inventors: Todd Housley, Dallas, TX (US); Charles Cluff Squires, McKinney, TX (US)

(73) Assignee: Todd B. Housley, Dallas, TX (US)

( * ) Notice: Subject to any disclaimer, the term of this patent is extended or adjusted under 35 U.S.C. 154(b) by 0 days.

(21) Appl. No.: 11/786,534

(22) Filed: Apr. 12, 2007

(65) Prior Publication Data

US 2008/0251486 A1 Oct. 16, 2008

(51) Int. Cl.
*A61J 9/04* (2006.01)

(52) U.S. Cl. ..... 215/12.1; 215/11.1; 215/11.5; 215/11.6; 40/310; 220/665

(58) Field of Classification Search ..... 215/11.1, 215/11.5, 11.6, 13.1, 12.1; 220/661, 665, 220/62.14; 40/310, 722
See application file for complete search history.

(56) References Cited

U.S. PATENT DOCUMENTS

| | | | | |
|---|---|---|---|---|
| 458,264 | A | 8/1891 | Alliger | |
| 566,761 | A * | 9/1896 | Hosmer | 40/310 |
| 1,230,419 | A | 6/1917 | Lowe | |
| 1,451,822 | A | 4/1923 | Hagerty | |
| 1,637,719 | A | 8/1927 | Whitlock | |
| 1,653,608 | A * | 12/1927 | Allen | 40/310 |
| 2,464,069 | A | 3/1949 | Benson | |
| D176,095 | S | 11/1955 | Berry et al. | |
| 2,843,281 | A | 7/1958 | Gallois | |
| 2,844,893 | A * | 7/1958 | Keller | 40/306 |
| 2,926,805 | A | 3/1960 | Mead | |
| 2,994,448 | A | 8/1961 | Sepe at al. | |
| 3,085,612 | A | 4/1963 | Gobel | |
| 3,113,569 | A | 12/1963 | Barr et al. | |
| 3,302,644 | A | 2/1967 | Kennedy et al. | |
| 3,531,009 | A | 9/1970 | Saperstem | |
| 3,627,161 | A * | 12/1971 | Wergeland | 215/11.6 |
| 3,737,093 | A * | 6/1973 | Amberg et al. | 206/447 |
| 3,738,524 | A | 6/1973 | Richie | |
| 4,007,246 | A | 2/1977 | Bailey | |
| 4,033,453 | A | 7/1977 | Giaimo | |
| 4,076,139 | A | 2/1978 | Larson | |
| 4,293,015 | A | 10/1981 | McGough | |
| 4,324,111 | A | 4/1982 | Edwards | |
| 4,344,303 | A | 8/1982 | Kelly, Jr. | |
| 4,372,453 | A | 2/1983 | Branscum | |
| 4,597,435 | A | 7/1986 | Fosco, Jr. | |
| 4,671,424 | A | 6/1987 | Byrns | |
| 4,678,093 | A | 7/1987 | Allen | |
| 4,708,254 | A | 11/1987 | Byrns | |
| 4,789,073 | A | 12/1988 | Fine | |
| 4,813,558 | A | 3/1989 | Fujiyoshi et al. | |

(Continued)

FOREIGN PATENT DOCUMENTS

| | | | |
|---|---|---|---|
| FR | 2530461 | | 1/1984 |
| GB | 2321413 | | 7/1998 |
| WO | WO 90/07320 | * | 7/1990 |

*Primary Examiner*—Sue A Weaver
(74) *Attorney, Agent, or Firm*—Gardere Wynne Sewell LLP

(57) ABSTRACT

A nursing bottle comprising a fluid container having a cushiony exterior sidewall and an object disposed between the fluid container and the exterior sidewall to enable viewing of the object through the exterior sidewall.

14 Claims, 3 Drawing Sheets

U.S. PATENT DOCUMENTS 4,850,496 A 7/1989 Rudell et al.
4,867,325 A 9/1989 Dransfield
4,869,207 A 9/1989 Engstrom et al.
4,895,264 A 1/1990 Phlaphongphanich et al.
4,898,060 A 2/1990 To et al.
4,928,412 A 5/1990 Nishiyama
4,928,836 A 5/1990 Wu et al.
4,944,704 A 7/1990 Grace
4,966,303 A 10/1990 Jones
4,974,741 A 12/1990 Gustafson et al.
4,979,325 A 12/1990 White
4,979,629 A 12/1990 Askerneese
5,040,317 A 8/1991 Kadjevich
D320,455 S 10/1991 Malcolm
5,054,660 A 10/1991 Sherman et al.
5,069,351 A * 12/1991 Gunderson et al. ..... 215/11.1
5,114,374 A 5/1992 Estiva
5,180,071 A 1/1993 Crosson
5,180,079 A 1/1993 Jeng et al.
5,211,299 A 5/1993 Manfredonia
5,215,312 A 6/1993 Knappe et al.
D342,574 S 12/1993 Cervantes et al.
5,269,426 A 12/1993 Morano
D349,190 S 8/1994 Wasserman
5,339,971 A 8/1994 Rohrig et al.
5,344,034 A 9/1994 Eagan
5,361,918 A * 11/1994 Mason ..... 215/6
5,401,200 A 3/1995 Ellis
5,406,808 A 4/1995 Babb et al.
5,411,155 A 5/1995 Gordon et al.
5,419,436 A 5/1995 Powell
5,423,509 A 6/1995 LaPorte et al.
5,431,290 A 7/1995 Vinciguerra
5,433,353 A 7/1995 Flinn
5,489,893 A 2/1996 Jo et al.
5,499,729 A * 3/1996 Greenwood et al. ..... 215/11.5
5,531,353 A 7/1996 Ward et al.
5,536,196 A 7/1996 Sternberg
5,553,735 A * 9/1996 Kimura ..... 362/101
5,570,796 A 11/1996 Brown et al.
5,593,053 A * 1/1997 Kaufman et al. ..... 215/12.1
5,607,074 A 3/1997 De Gennaro
5,669,538 A 9/1997 Ward
5,699,921 A * 12/1997 Rodriguez ..... 215/11.5
D390,964 S 2/1998 Mercer et al.
5,753,289 A 5/1998 Ness
5,779,071 A 7/1998 Brown et al.
5,807,156 A 9/1998 Owen
5,842,901 A 12/1998 Montgomery
5,873,551 A * 2/1999 Jones ..... 248/102
5,938,053 A 8/1999 Verbovszky et al.
5,967,307 A 10/1999 Wang et al.
6,041,852 A * 3/2000 Sato et al. ..... 165/114
6,042,850 A * 3/2000 Ida et al. ..... 426/2
6,053,342 A 4/2000 Chomik
6,073,788 A 6/2000 Stroud
6,104,292 A 8/2000 Rombom et al.
6,138,710 A 10/2000 Chomik et al.
D435,108 S 12/2000 Chomik et al.
6,158,870 A 12/2000 Ramirez
6,164,469 A * 12/2000 Sartore ..... 215/12.1
6,216,856 B1 4/2001 Park
6,253,935 B1 7/2001 Fletcher
6,289,906 B1 9/2001 Vanden Dries et al.
D450,387 S 11/2001 Gaona
6,391,972 B1 * 5/2002 Hatakeyama ..... 525/191
6,413,137 B1 7/2002 Myers, Sr.
D463,568 S * 9/2002 Leung ..... D24/197
6,443,800 B1 9/2002 Rice
6,605,342 B1 8/2003 Burghaus et al.
6,631,819 B1 * 10/2003 Diak/Ghanem ..... 215/11.1
6,652,346 B1 11/2003 Arnold, III
6,666,417 B1 12/2003 Wright
6,681,958 B2 1/2004 Sorenson et al.
6,747,092 B2 * 6/2004 Kwak et al. ..... 524/569
D501,361 S 2/2005 Tollman et al.
D501,841 S 2/2005 Hsu et al.
6,871,751 B2 3/2005 Kerns et al.
7,007,819 B2 3/2006 Pollack
2002/0020686 A1 2/2002 Stull et al.
2002/0160345 A1 10/2002 Hempton
2002/0166835 A1 11/2002 Carter
2003/0000910 A1 1/2003 Jang et al.
2003/0141268 A1 7/2003 Kerns et al.
2004/0031797 A1 2/2004 Farnsworth et al.
2004/0071942 A1 4/2004 Schulthers
2005/0040129 A1 2/2005 Coffey
2005/0045642 A1 3/2005 Vance
2005/0082177 A1 4/2005 Weiss et al.
2005/0082295 A1 4/2005 Jagger et al.
2005/0092754 A1 5/2005 Marsden et al.
2005/0184024 A1 8/2005 Santa Cruz et al.
2005/0263475 A1 12/2005 Carlson et al.
2006/0037962 A1 2/2006 Kim

* cited by examiner

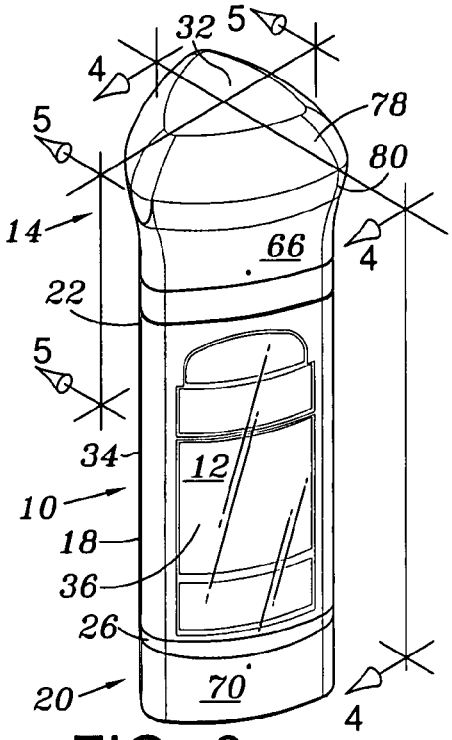
FIG. 3
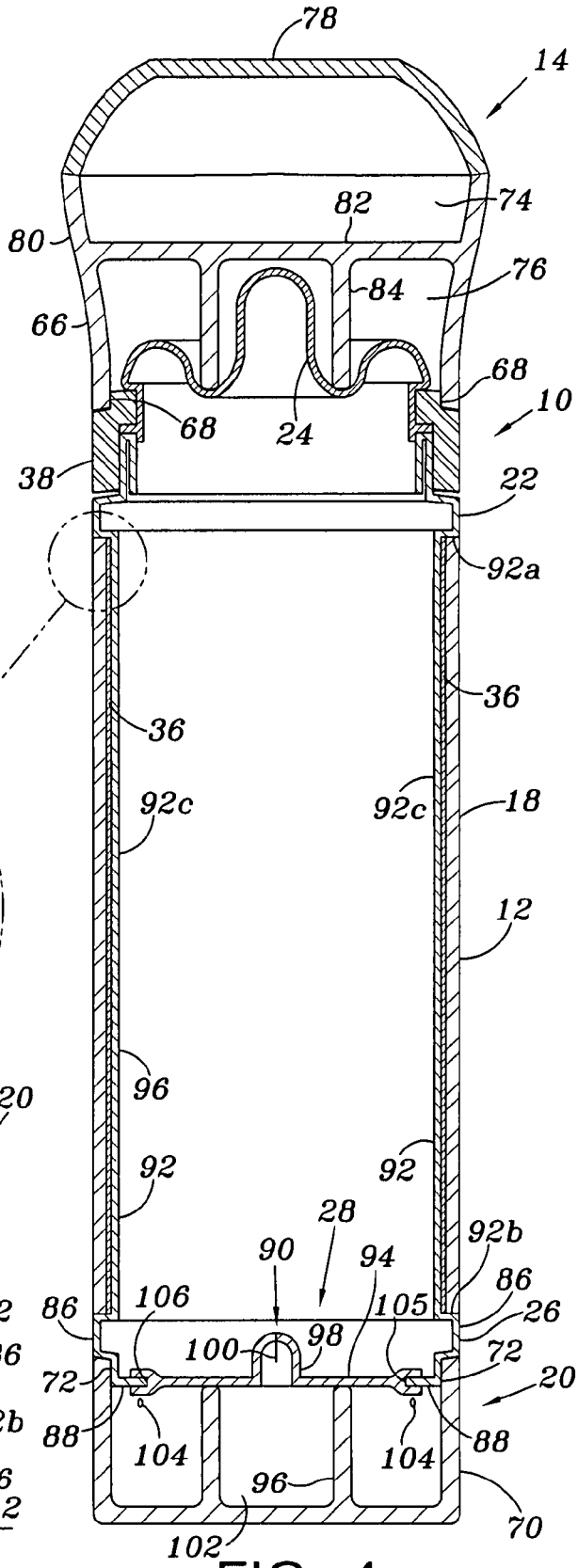
FIG. 4
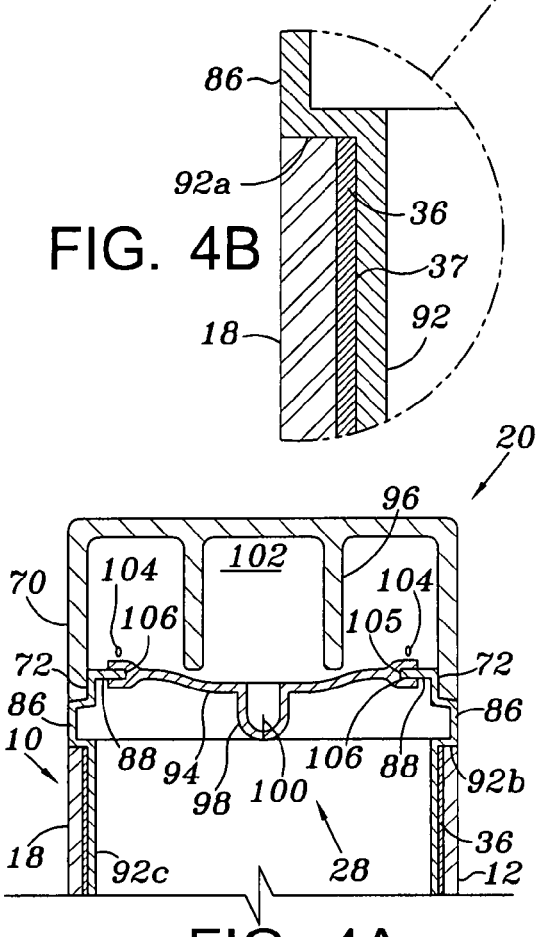
FIG. 4B
FIG. 4A

NURSING BOTTLE WITH CUSHIONY EXTERIOR SIDEWALL

BACKGROUND

Nursing bottles are typically fabricated from a stiff material such as plastic and lack insulative capabilities. As a result, it may be difficult, uncomfortable and/or undesirable for an infant to hold the bottle during feedings. Further, due to the lack of insulation, infants may resist holding the bottle, such as for example, during instances when the liquid therein (i.e., formula, water, juice, etc.) is at an unusual temperature (e.g., too cold) thereby making it uncomfortable to grip the bottle. Furthermore, it is difficult to store loose items (e.g., the bottle cap, pacifiers, etc.), which must oftentimes be readily accessible for the infant.

BRIEF DESCRIPTION OF THE DRAWINGS

For a more complete understanding of the present invention, and the objects and advantages thereof, reference is now made to the following descriptions taken in connection with the accompanying drawings in which:

FIG. 3 is a diagram illustrating front perspective view of the nursing bottle of FIG. 1;

FIG. 4 is a diagram illustrating a section view of the nursing bottle of FIG. 3 taken along the line 4-4 of FIG. 3;

FIG. 4A is a diagram of a section view of the bottom portion of the nursing bottle of FIG. 4 in the inverted position illustrating the venting system in the open position;

FIG. 4B is a diagram illustrating a detailed view of a portion of the sidewall of the nursing bottle of FIG. 4;

DETAILED DESCRIPTION OF THE DRAWINGS

The preferred embodiments of the present invention and the advantages thereof are best understood by referring to FIGS. 1-7 of the drawings, like numerals being used for like and corresponding parts of the various drawings.

Figure 1:
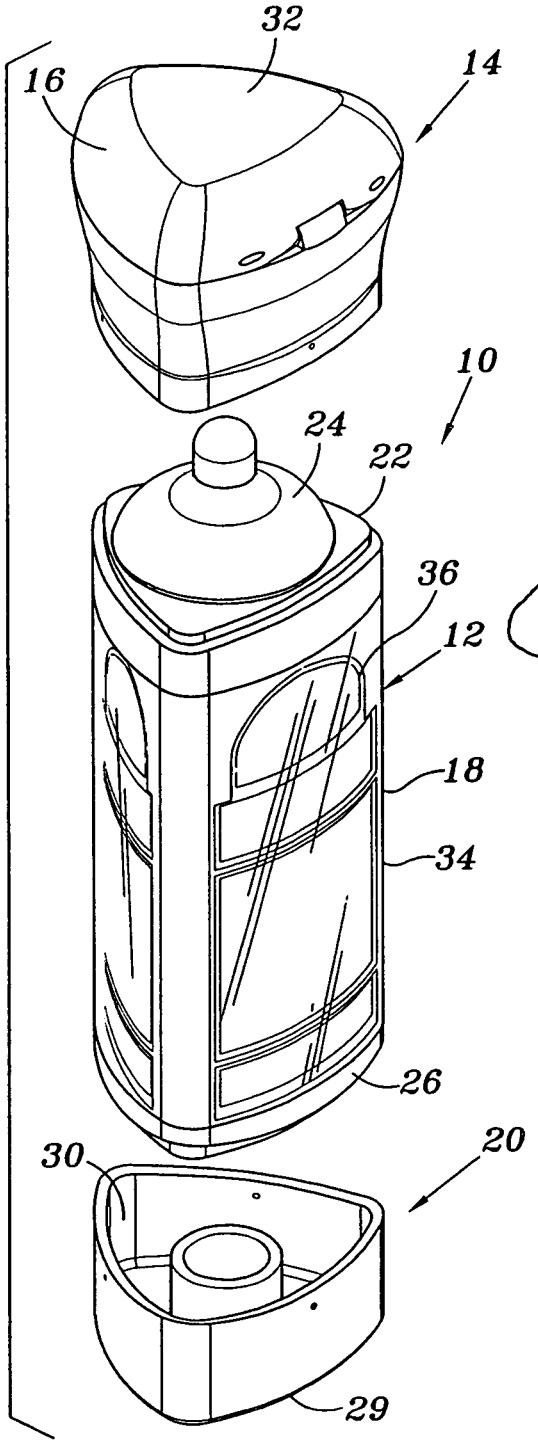
FIG. 1 is a diagram illustrating a partial exploded view of a nursing bottle in which a cushiony sidewall is employed to advantage.

FIG. 1 is a diagram of a nursing bottle 10 in which an embodiment of a transparent and cushiony exterior sidewall 12 is employed to advantage. In the embodiment illustrated in FIG. 1, nursing bottle 10 comprises a cap 14 having a storage compartment 16, a fluid container 18 and a base member 20. According to some embodiments, cap 14 and base member 20 are removably coupleable to fluid container 18. For example, cap 14 is coupleable to a first end 22 of container 18 to enclose and protect a nipple 24. Base member 20 is coupleable to a second end 26 of container 18 to provide a venting system 28 (FIGS. 4 and 4A) and a storage compartment 30. Additionally, cap 14 is removable from first end 22 and coupleable to base member 20 or directly to second end 26 of fluid container 18. It should be understood that nursing bottle 10 is usable without cap 14 and/or base member 20 and further, it should be understood that base member 20 is removably coupleable to first end 22 of container 18. In the embodiment illustrated in FIG. 1, cap 14 and base member 20 frictionally engage first and second ends 22 and 26, respectively; however, it should be understood that other methods of attachment are available (e.g., a threaded connection). Additionally or alternatively, it should be understood that base member 20 may be formed integral with container 18 (e.g., contiguously formed with container 18). Cap 14 comprises a flat top surface 32 to support nursing bottle 10 in an upright position when cap is coupled to first end 22, second end 26 and/or base member 20.

In the embodiment illustrated in FIG. 1, exterior sidewall 12 is transparent to enable viewing of an object 36 disposed beneath sidewall 12 (e.g., on the inward side of sidewall 12 facing container 18). Object 36 may comprise for example, a photograph, a drawing, an artistic item or any informational item viewable through sidewall 12 for purposes such as, but not limited to, identification of nursing bottle 10, providing a decorative element to nursing bottle 10 and/or enjoyment by an infant. In addition, it should be understood that object 36 may be printed directly on or otherwise directly attached to the inward side of sidewall 12. Furthermore, it should be understood that sidewall 12 may be translucent (causing sufficient diffusion to prevent perception of a distinct image), opaque (impenetrable by light) or a combination thereof.

In the embodiment illustrated in FIG. 1, sidewall 12 is fabricated from a soft, cushiony and/or compressible material to provide a comfortable gripping and handling surface for an infant or other user. According to some embodiments, sidewall 12 is formed of a resin mixture such as, but not limited to, polyvinyl chloride having a plasticizer mixed therein to provide a soft, cushiony, and compressible sidewall 12. In some embodiments, sidewall 12 is formed of a styrenic elastomer. According to some embodiments, exterior sidewall 12 insulates fluids disposed within fluid container 18. In the embodiment illustrated in FIG. 1, exterior sidewall 12 extends around the circumference of nursing bottle 10 and extends between first and second ends 22 and 26; however, it should be understood that exterior sidewall 12 may be otherwise configured (e.g., extending only partially around the circumference of nursing bottle 10 and partially between first and second ends 22 and 26).

In the embodiment illustrated in FIG. 1, fluid container 18 comprises a generally non-circular cross-section along its longitudinal length (e.g., extending from first end 22 to second end 26) to reduce or eliminate the rolling tendencies of nursing bottle 10 in instances when nursing bottle is on a flat surface (e.g., when dropped by an infant during use). Furthermore, the non-circular cross-sectional shape of fluid container 18 provides a comfortable gripping surface 34 for an infant. In the embodiment illustrated in FIG. 1, the cross-section of fluid container 18 comprises a tri-angular cross section; however, it should be understood that the cross sectional area of fluid container 10 may be otherwise configured (e.g., oval, square, rectangular, etc.) to enable ease of gripping while also preventing or substantially eliminating the rolling tendencies of fluid container 18. Additionally, cap 14 and base member 20 comprise a generally non-circular cross-section to reduce or eliminate the rolling tendencies of nursing bottle 10. In the embodiment illustrated in FIG. 1, cap 14 and base member 20 comprise a generally tri-angular cross sectional shape corresponding to the cross sectional shape of fluid container 18; however, it should be understood that cap 14 and base member 20 can be any cross sectional shape.

Figure 2:
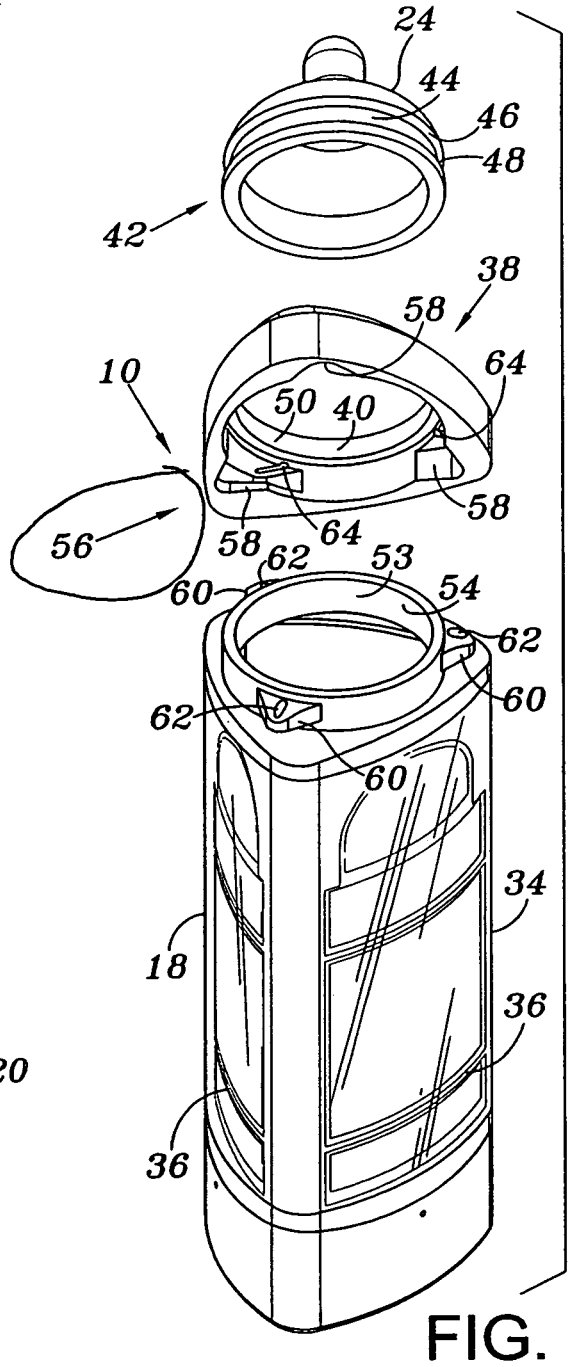
FIG. 2 is a diagram illustrating a partial exploded view of the nursing bottle of FIG. 1.

FIG. 2 is a partial exploded view of nursing bottle 10 of FIG. 1. In the embodiment illustrated in FIG. 2, nipple 24 is removably coupleable to a collar 38 to securely fasten nipple 24 to fluid container 18. Collar 38 comprises an opening 40 sized to receive at least a portion of nipple 24. In the embodiment illustrated in FIG. 2, nipple 24 comprises a base portion 42 in which a groove 44 is disposed around the periphery of base portion 42. Groove 44 is defined by a pair of shoulders 46 and 48 sized to receive a lip 50 extending around the periphery of opening 40 to form a liquid-tight seal between nipple 24 and collar 38. Nipple 24 is attachable/removable from collar 38 for cleaning or storage by deforming at least a portion of nipple 24 to retract shoulders 46 and 48 to permit insertion/removal of lip 50 to/from groove 44.

In the embodiment illustrated in FIG. 2, fluid container 18 comprises a rim 53 defining an opening 54 sized to enable formula and other fluids to be filled or emptied from fluid container 18. Opening 54 is a generally circular opening sized to align and correspond to opening 40 in collar 38. During use, collar 38 and nipple 24 are aligned with and enclose opening 54.

In the embodiment illustrated in FIG. 2, collar 38 is securely fastened to fluid container 18 by a locking mechanism 56. According to some embodiments, locking mechanism 56 comprises a plurality of recessed areas 58 disposed on collar 38 configured to receive a plurality of corresponding tabs 60 disposed on and extending from rim 53 on fluid container 18. In operation, each tab 60 is aligned with the corresponding recessed area 58 for insertion therein. After insertion of each tab 60 within recessed areas 58, collar 38 is rotated relative to fluid container 18 to enable a detent 62 each on tab 60 to frictionally engage a corresponding groove 64 on collar 38, to lock and/or otherwise restrict relative movement between collar 38 and fluid container 18. In the embodiment illustrated in FIG. 2, locking mechanism 56 comprises three tabs 60 and three corresponding recessed areas 58; however, it should be understood that a greater or fewer number of tabs 60 and/or recesses 58 may be utilized. Furthermore, it should be understood that locking mechanism 56 may be otherwise configured (e.g., detent 62 disposed on collar 38 and groove 64 disposed on tab 60), or alternatively, locking mechanism 56 may comprise a threaded connection between collar 38 and nursing bottle 10 to securely fasten collar 38 and fluid bottle 18.

FIG. 3 is a diagram illustrating a front perspective view of nursing bottle 10 of FIG. 1. FIG. 4 is a diagram illustrating a section view of nursing bottle 10 of FIG. 3 taken along the line 4-4 of FIG. 3. In the embodiment illustrated in FIGS. 3 and 4, cap 14 comprises a skirt 66 to frictionally engage a shoulder 68 of collar 38. Similarly, base member 20 comprises a skirt 70 sized to frictionally engage a shoulder 72 of fluid container 18 at second end 26.

In the embodiment illustrated in FIGS. 3 and 4, cap 14 comprises a storage compartment 74 for storing loose items therein and a nipple cover 76 to enclose and otherwise protect nipple 24 when cap 14 is coupled to fluid bottle 18 at first end 22. In the embodiment illustrated in FIG. 4, storage compartment 74 is formed by a lid 78, a sidewall 80 and a bottom wall 82. Compartment 74 is sized to receive various objects such as for example, a pacifier, medicines and/or desired amounts of formula/foods for storage therein. In the embodiment illustrated in FIGS. 3 and 4, nipple cover 76 is formed from bottom wall 82 and skirt 66 such that when coupled to fluid container 18, nipple 24 is protected or otherwise enclosed to maintain a sanitary environment between feedings and/or during storage. In the embodiment illustrated in FIG. 4, storage compartment 76 comprises a nipple compressing mechanism 84 extending from bottom wall 82 such that as cap 14 is aligned with and coupled to fluid bottle 18, nipple compressor 84 engages and otherwise exerts a force on nipple 24 to compress nipple 24 inward toward fluid container 18. Accordingly, when cap 14 is coupled to fluid bottle 18, the effective length of nursing bottle 10 is shortened.

FIG. 4A is a diagram of a section view of the bottom portion of nursing bottle 10 of FIG. 4 in the inverted position and illustrating venting system 28 in the open position. In the embodiment illustrated in FIGS. 4 and 4A, venting system 28 comprises base member 20 and a flexible valve 94 disposed on a bottom wall 88 of fluid container 18 to facilitate venting of nursing bottle 10. In the embodiment illustrated in FIGS. 4 and 4A, base member 20 comprises a valve seat 96 for sealing engagement with flexible valve 94. Flexible valve 94 comprises an extension 98 having a slit/opening 100 to enable airflow inside nursing bottle 10. In the embodiment illustrated in FIGS. 4 and 4A, flexible valve 94 is movable between a closed position (e.g., flexible valve 94 in sealing engagement with valve seat 96 as illustrated in FIG. 4) to prevent airflow through opening 100 and thus inside fluid container 18 and an open position (e.g., flexible valve 94 is deformed and spaced apart from valve seat 96 as illustrated in FIG. 4A) to enable an airflow through opening 100 and within fluid container 18.

In use, as an infant drinks through nipple 24, a vacuum is created within container 18 thereby causing flexible valve 94 to configure in the open position (FIG. 4A). When in the open position, air is drawn inside nursing bottle 10 through at least one opening 104 disposed on base member 20. Air flows through base member 20 and into fluid container 18 via opening 100 to vent and/or otherwise reduce the vacuum pressure buildup inside fluid container 18. In the embodiment illustrated in FIGS. 4 and 4A, two openings 104 are illustrated; however, it should be understood that a greater or fewer number of openings 104 may be utilized. Likewise, additional openings 100 may also be utilized on flexible valve 94 to increase the airflow rate within fluid container 18. When bottle 10 is not in use, such as for example, when bottle 10 is configured in an upright position as illustrated in FIG. 4, flexible valve 94 returns to the closed position such that valve 94 in sealing engagement against valve seat 96 to prevent or substantially eliminate air flow inside container 18 through opening 100. Any excess fluids within fluid container 18 that my coincidentally leak through opening 100 will be contained within a chamber 102 formed by valve seat 96 to prevent fluid from exiting nursing bottle 10.

In the embodiment illustrated in FIGS. 4 and 4A, flexible valve 94 is disposed within an opening 105 of fluid container 18 and comprises a groove 106 disposed around the periphery of flexible valve 94 to engage base member opening 105 to securely fasten flexible valve 94 to fluid container 18. Flexible valve 94 is removable from fluid container 18 for cleaning or storage. Likewise, base member 20 is removable from fluid container 18 so as to enable cleaning of base member 20 to remove any fluids that may collect within chamber 102. In the embodiment illustrated in FIGS. 4 and 4A, flexible valve 94 is fabricated from any material that is flexible that may deform and return to its original shape, such as for example, a rubber material.

FIG. 4B is a diagram illustrating a detailed view of a portion of nursing bottle 10 of FIG. 4. In the embodiment illustrated in FIGS. 4 and 4B, fluid container 18 is formed by a sidewall 86 and bottom wall 88. Sidewall 86 comprises a recessed area 92 configured to receive object 36 and exterior sidewall 12. According to some embodiments, recessed area 92 comprises a top wall 92*a*, a bottom wall 92*b* and a sidewall 92*c* to enable exterior sidewall 12 to rest flush (or substantially flush) with sidewall 86. It should be understood, however, that sidewall 12 may extend beyond sidewall 86.

In the embodiment illustrated in FIG. 4B, object 36 is disposed within recessed area 92 between sidewall 92*c* and exterior sidewall 12 and is outwardly oriented such that the contents on object 36 are viewable through sidewall 12. For example, according to some embodiments, object 36 comprises a photograph 37 oriented such that the contents of photograph 37 face exterior sidewall 12 to be viewable therethrough.

According to some embodiments, exterior sidewall 12 is melted/fused directly to top wall 92*a* and bottom wall 92*b* to securely fasten sidewall 12 to fluid container 18. Sidewall 12 adheres to top wall 92*a* and bottom wall 92*b* to form an airtight and waterproof seal to protect object 36 from damage, such as for example, damaging contact with water, such as for example, when washing nursing bottle 10. Furthermore, according to some embodiments, object 36 is coupleable to sidewall 92*c* via an adhesive; however, it should be understood that object 36 may be otherwise coupled (e.g., fused/melted to and/or printed directly on sidewall 92*c*). Alternatively, object 36 may be free floating between sidewalls 92*c* and 12 and/or fused/attached to and/or printed directly on exterior sidewall 12.

Figure 5:
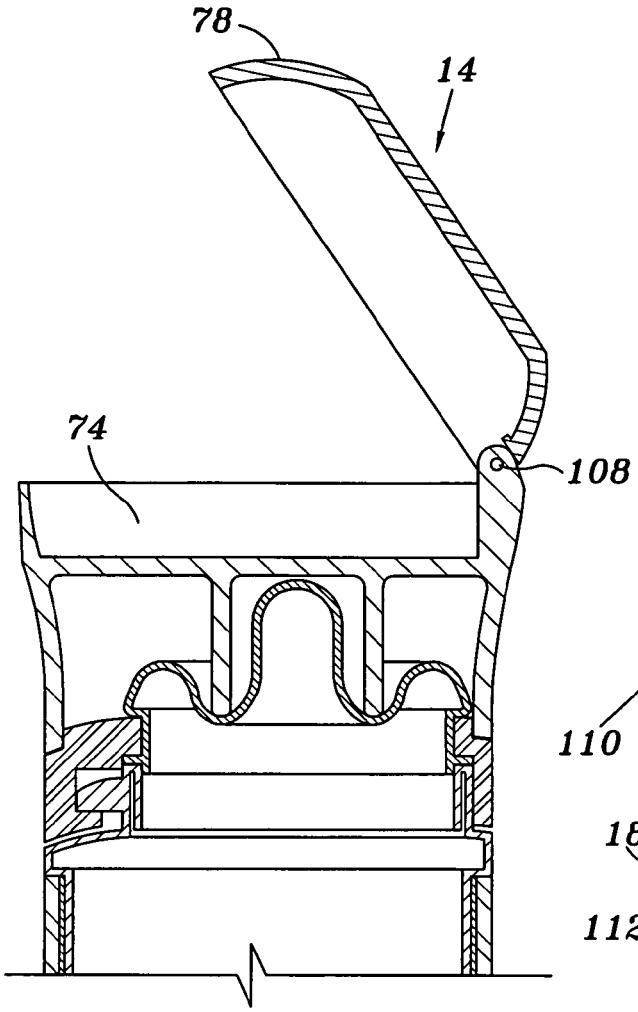
FIG. 5 is a diagram illustrating a section view of a portion of the nursing bottle of FIG. 3 taken along the line 5-5 illustrating a storage compartment lid in the open position.

FIG. 5 is a diagram illustrating a section view of a portion of nursing bottle 10 of FIG. 3 taken along the line 5-5 illustrating a storage compartment lid 78 in the open position. In the embodiment illustrated in FIG. 5, lid 78 is pivotably coupled to cap 14 via a pin 108. In the embodiment illustrated in FIG. 5, lid 78 is movable between an open position (FIG. 5), to enable access to storage compartment 74, and a closed position (e.g., FIGS. 3 and 4) to enclose storage compartment 74. It should be understood that lid 78 may be otherwise configured, such as for example, lid may be a detachable lid 78 that snaps and/or frictionally engages a portion of cap 14 to enclose storage compartment 74.

Figure 6:
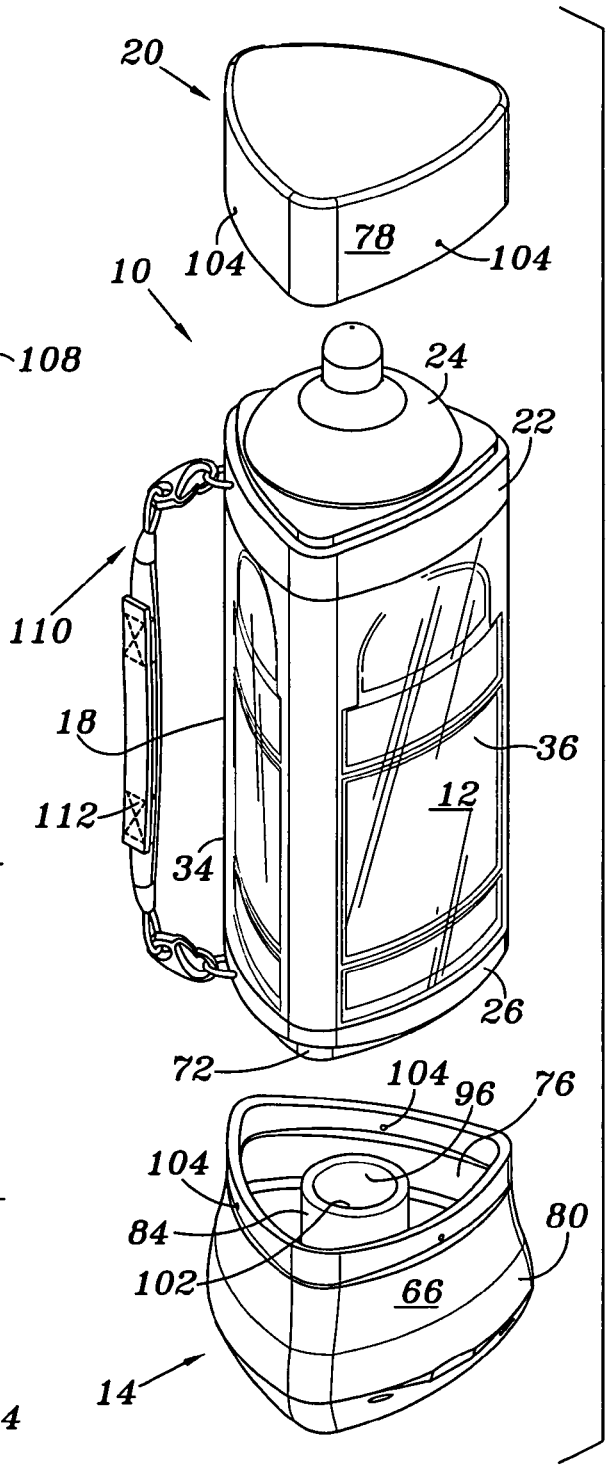
FIG. 6 is a diagram of a partial exploded view of a nursing bottle of FIG. 1 in accordance with an embodiment in which the cap is coupleable to the bottom wall of the nursing bottle.

FIG. 6 is a partial exploded view of nursing bottle 10 of FIG. 1 in accordance with the present invention in which cap 14 is coupleable to second end 26 of nursing bottle 10. In the embodiment illustrated in FIG. 6 cap 14, is inverted such that skirt 66 frictionally engages shoulder 72 to secure cap 14 to second end 26 of fluid container 18. According to embodiments of the present invention, nipple compressing mechanism 84 is sized such that in instances when cap 14 is coupled to second end 26, nipple compressing mechanism 84 also functions as valve seat 96 and chamber 102 to enable sealing engagement between nipple compressing mechanism 84 and flexible valve 94 (FIG. 4) while also containing any formula that may leak through opening 100 (FIG. 4). Accordingly, nursing bottle 10 may be vented with cap 14 secured to second end 26 during feedings. In operation, an airflow path is formed through openings 104 disposed on cap 14 to enable airflow within fluid container 18 (FIG. 4). Furthermore, when cap 14 is coupled to second end 26, nipple compartment 76 is also utilized as an additional storage area.

In the embodiment illustrated in FIG. 6, nursing bottle 10 comprises a carrying system 110 comprising a strap 112. According to some embodiments, strap 112 is an adjustable length strap to enable carrying and/or easy gripping of fluid container 18 removably coupleable to ends 22 and 26. In addition, strap 112 may be configured to connect to couple nursing bottle 10 to any structure, such as, but not limited to, a stroller, a chair, a diaper bag, etc. and may be stretchable.

Figure 7:
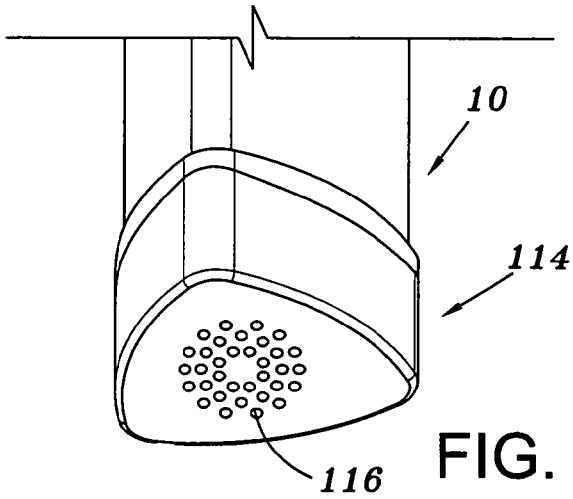
FIG. 7 is a diagram of a bottom perspective view of the nursing bottle of FIG. 1 in which a music player is coupled thereto in accordance with the present invention.

FIG. 7 is a bottom view of nursing bottle 10 of FIG. 1 in which a music player 114 is coupled thereto in accordance with the present invention. In the embodiment illustrated in FIG. 7, music player 114 comprises speaker 116 to enable the playback of audio excerpts such as prerecorded audio and other sounds. In the embodiment illustrated in FIG. 7, music player 114 comprises a memory to enable the storage or playback of the audio and sounds; however, it should be understood that music player 114 may be otherwise configured (e.g., a mechanically driven hand cranked music player). It should be understood that music player 114 may be configured so as to replace base member 20 so as to enable venting of nursing bottle 10.

While exterior sidewall 12 is illustrated in connection with a nursing bottle 10, it should be understood that exterior sidewall may be used with water bottles, cups, mugs or any other drinking device or container.

Other alterations and modifications of the invention will likewise become apparent to those of ordinary skill in the art upon reading the present disclosure, and it is intended that the scope of the invention disclosed herein be limited on by the broadest interpretations of the appended claims to which the inventors are legally entitled.

What is claimed is:

1. A nursing bottle, comprising:

a fluid container having a sidewall, the sidewall having a recessed area formed by a top wall, a bottom wall and a recessed area sidewall;

a cushiony exterior sidewall disposed within the recessed area and around the fluid container sidewall, the exterior sidewall coupled to the top wall and the bottom walls; and an object disposed between the fluid container sidewall and the exterior sidewall to enable viewing of the object through the exterior sidewall.

2. The nursing bottle of claim 1, wherein the exterior sidewall comprises a styrenic elastomer.

3. The nursing bottle of claim 2, wherein the exterior sidewall comprises polyvinylchloride.

4. The nursing bottle of claim 1, wherein the object is coupled to the exterior sidewall.

5. The nursing bottle of claim 1, wherein the exterior sidewall is transparent.

6. The nursing bottle of claim 1, wherein the object is a photograph.

7. The nursing bottle of claim 1, wherein the object is adhered to an inner surface of the exterior sidewall.

8. The nursing bottle of claim 1, further comprising a cap removably coupleable to the nursing bottle, the cap having a first and second compartment.

9. The cap of claim 8, wherein the cap is coupleable to a first and second end of the nursing bottle.

10. The nursing bottle of claim 1, wherein the fluid container comprises a noncircular cross sectional area.

11. The nursing bottle of claim 1, further comprising a cap having a non-circular cross sectional area.

12. The nursing bottle of claim 1, further comprising an adjustable carrying length strap.

13. The nursing bottle of claim 1, further comprising a removeably coupleable music player.

14. A drinking container, comprising:

a fluid container having a cushiony exterior sidewall extending around a periphery of the fluid container;

the cushiony exterior sidewall comprising an inner surface having an object disposed thereon to enable viewing of the object through the exterior sidewall; and wherein the cushiony exterior sidewall is disposed within a recessed area of a sidewall of the fluid container, the recessed area having a top wall, a bottom wall and a recessed area sidewall, the cushiony exterior sidewall coupled to the top wall and the bottom wall.

* * * * *